US005881472A

United States Patent [19]

Grunder et al.

[11] Patent Number: 5,881,472

[45] Date of Patent: Mar. 16, 1999

[54] VENTILATOR APPARATUS FOR INHIBITING FLUTTER IN A WEB DRYER

[75] Inventors: Thomas K. Grunder, Beloit, Wis.; Remi Turcotte, Lery, Canada; David Young, Mobile, Ala.

[73] Assignee: Beloit Technologies, Inc., Wilmington, Del.

[21] Appl. No.: 955,541

[22] Filed: Oct. 22, 1997

[51] Int. Cl.[6] ..... D21F 5/00

[52] U.S. Cl. ..... 34/114

[58] Field of Search ..... 34/114, 116, 117, 34/119, 122, 124

[56] References Cited

U.S. PATENT DOCUMENTS

| | | | |
|---|---|---|---|
| 4,485,567 | 12/1984 | Ely | 34/114 X |
| 4,516,330 | 5/1985 | Eskelinen et al. | 34/114 X |
| 4,669,198 | 6/1987 | Wedel | 34/114 X |
| 5,086,571 | 2/1992 | Hietanen | 34/117 |
| 5,557,863 | 9/1996 | Kokkala | 34/17 X |

*Primary Examiner*—Henry Bennett
*Assistant Examiner*—Steve Gravini
*Attorney, Agent, or Firm*—Raymond W. Campbell; Gerald A. Mathews

[57] ABSTRACT

A ventilator apparatus is disclosed for supplying air from a source of pressurized air between a dryer and a web supported by a felt extending around a roll of a single tier drying section. The apparatus includes a housing which is connected to the source of pressurized air. The housing defines a nozzle for directing a flow therethrough of a current of air. The flow is directed from the nozzle towards a diverging nip defined between the dryer and the web supported by the felt when the felt diverges away from the dryer prior to the felt extending around the roll. The arrangement is such that the flow of air compensates for an underpressure generated by the felt when diverging away from the dryer so that fluttering of the web is inhibited.

16 Claims, 3 Drawing Sheets

VENTILATOR APPARATUS FOR INHIBITING FLUTTER IN A WEB DRYER

BACKGROUND OF THE INVENTION

1. Field of the Invention

The present invention relates to a ventilator apparatus for supplying air from a source of pressurized air between a dryer and a web supported by a felt extending around a roll.

More specifically, the present invention relates to a ventilator apparatus for supplying air from a source of pressurized air between the dryer and a web supported by a felt extending around a roll of a single tier drying section of a paper machine.

2. Information Disclosure Statement

In the operation of a Bel-Champ type single tier drying section, the web supported by a dryer felt extends around a heated drying cylinder. Subsequently, the dryer felt diverges relative to the surface of the drying cylinder and thereafter extends around a roll such as a vacuum roll. Bel-Champ is a common law trademark of Beloit Corporation.

The web follows the felt when the felt diverges relative to the drying cylinder. However, there is a tendency for a slight underpressure to be generated at the diverging nip defined between the surface of the dryer and the diverging dryer felt. Such slight underpressure tends to cause a flow of ambient air toward such diverging nip and such flow of ambient air is detrimental to the movement of the web contiguously with the felt.

Additionally, such flow of ambient air flows in from the edges of the felt and has a tendency to generate edge flutter of the web.

Also, there exists a tendency of the web to follow the heated surface of the dryer cylinder rather than the surface of the diverging felt.

The present invention overcomes the aforementioned problems associated with the prior art arrangements by the provision of a ventilator apparatus, disposed in the vicinity of the aforementioned diverging nip. The ventilator apparatus which is connected to a supply of pressurized air generates a current of air which is directed into the diverging nip. The current of air compensates for any underpressure generated by the felt when diverging away from the dryer so that fluttering of the web is inhibited.

Therefore, it is a primary objective of the present invention to provide a ventilator apparatus which overcome the problems associated with the prior art drying section arrangements and which makes a considerable contribution to the art of drying paper.

Other objects and advantages of the present invention will be readily apparent to those skilled in the art by a careful consideration of the detailed description contained hereinafter taken in conjunction with the annexed drawings.

SUMMARY OF THE INVENTION

The present invention relates to a ventilator apparatus for supplying air from a source of pressurized air between a dryer and a web supported by a felt extending around a roll of a single tier drying section. The apparatus includes a housing which is connected to the source of pressurized air. The housing defines a nozzle for directing a flow therethrough of a current of air.

The flow is directed from the nozzle toward a diverging nip which is defined between the dryer and the web supported by the felt when the felt diverges away from the dryer prior to the felt extending around the roll. The arrangement is such that the flow of air compensates for an underpressure generated by the felt when diverging away from the dryer so that fluttering of the web is inhibited.

In a more specific embodiment of the present invention, the housing extends in a cross-machine direction across a full width of the felt.

Also, the housing includes a first portion which is of generally rectangular configuration and a second portion of generally tapered configuration. The second portion is disposed between the first portion and the diverging nip.

The first portion provides rigidity to the housing and the second portion includes a first wall which extends from the first portion. A second wall of the second portion extends from the first portion. The second wall converges towards the first wall in a direction from the first portion towards the diverging nip.

The second portion being tapered enables the housing to be disposed in close proximity relative to the diverging nip.

Additionally, the ventilator apparatus also includes a baffle which is disposed between the first portion and the second portion. The baffle defines a plurality of perforations, the arrangement being such that when the first portion is connected to the source of pressurized air, the perforated baffle distributes the pressurized air into the second portion prior to the current of air flowing through and from the nozzle.

The second wall has a first and a second end. The first end is disposed adjacent to the first portion and the second end defines the nozzle.

In a preferred embodiment of the present invention, the nozzle is a slot which extends in a cross-machine direction along the entire width of the felt.

In another embodiment of the present invention, the nozzle includes a plurality of holes which extend in the cross-machine direction across an entire cross-machine directional width of the felt.

Additionally, the ventilator apparatus further includes a doctor which cooperates with the dryer. The housing is disposed closely adjacent to the doctor such that the doctor and the housing cooperate together for directing the current of air towards the diverging nip.

Also, the tapered second portion permits guidance therepast of broke removed from the dryer by the doctor.

In operation of the apparatus, the current of air assists in urging the web against the felt during travel of the felt between the dryer and the roll thereby stabilizing the web relative to the felt.

The current of air flows from the nozzle preferably at a velocity of at least 4,000 feet per minute.

Many modifications and variations of the present invention will be readily apparent to those skilled in the art by a consideration of the detailed description contained hereinafter taken in conjunction with the annexed drawings. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
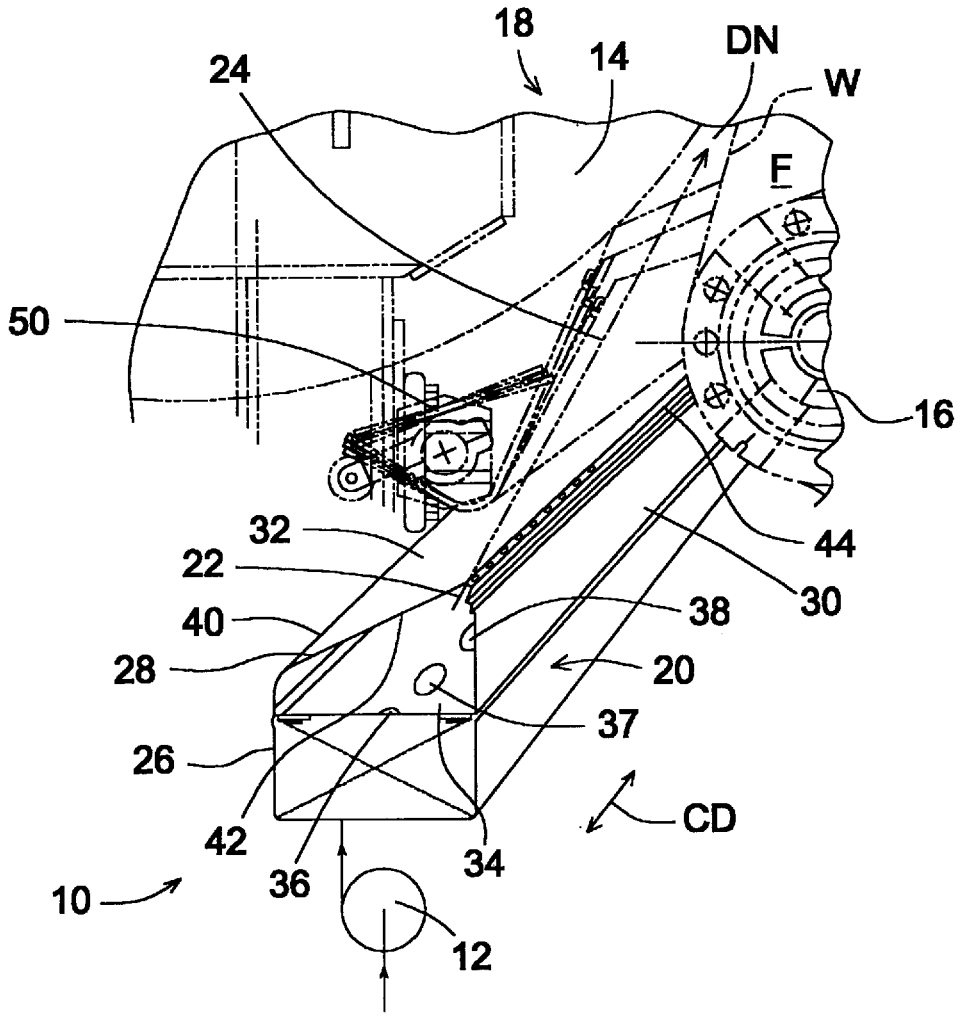
FIG. 1 is a perspective view of the ventilator apparatus according to the present invention showing the doctor in operative engagement with the dryer and in an inoperative dispostive thereof.
Figure 2:
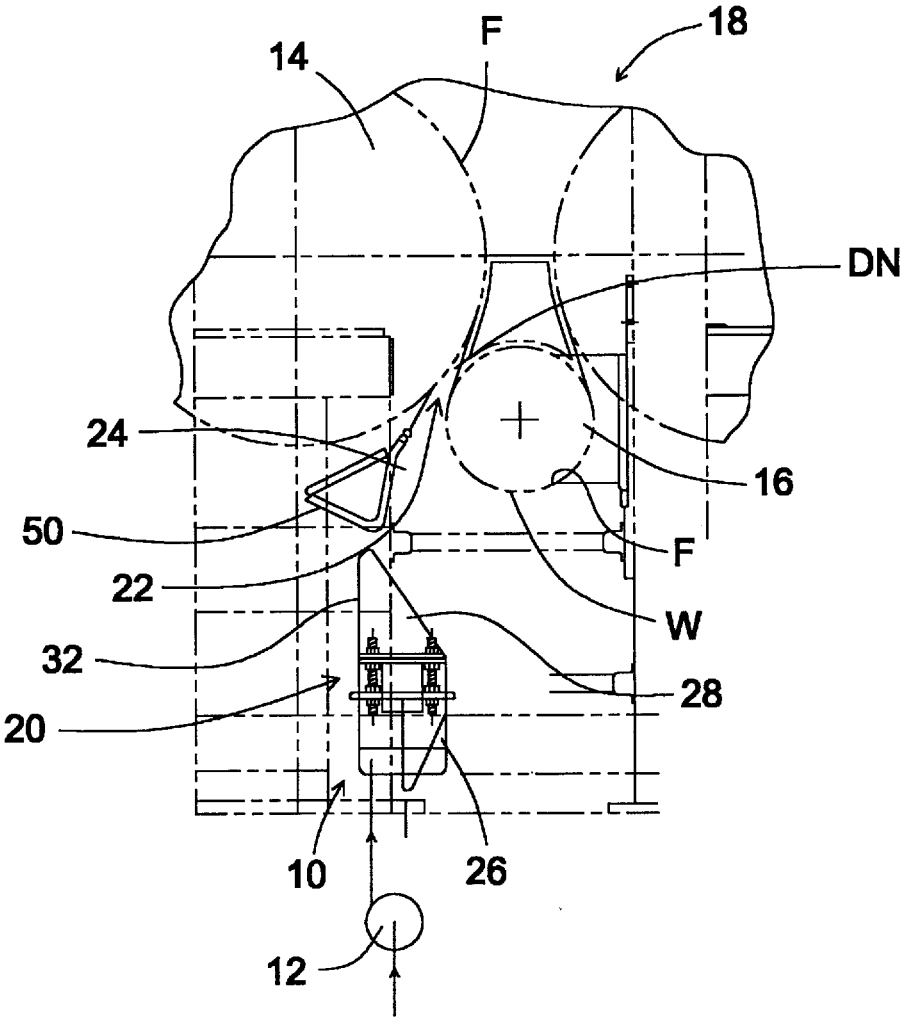
FIG. 2 is a side elevational view of the ventilator apparatus according to the present invention as shown in FIG. 1.

FIGS. 1 and 2 show a ventilator apparatus generally designated 10 according to the present invention for supplying air from a source of pressurized air 12 between a dryer 14 and a web W supported by a felt F extending around a roll 16 of a single tier drying section generally designated 18. The apparatus 10 includes a housing generally designated 20 which is connected to the source of pressurized air 12. The housing 20 defines a nozzle 22 for directing a flow therethrough of a current of air as indicated by the arrow 24. The flow 24 is directed from the nozzle 22 towards a diverging nip DN which is defined between the dryer 14 and the web W supported by the felt F when the felt F diverges away from the dryer 14 prior to the felt F extending around the roll 16. The arrangement is such that the flow of air 24 compensates for an underpressure generated by the felt F when diverging away from the dryer 14 so that fluttering of the web W is inhibited.

The housing 20 extends in a cross-machine direction as indicated by the arrow CD across a full width of the felt F.

Additionally, the housing 20 includes a first portion 26 of generally rectangular configuration and a second portion 28 of generally tapered configuration. The second portion 28 is disposed between the first portion 26 and the diverging nip DN.

The first portion 26 provides rigidity to the housing 20.

The second portion 28 includes a first wall 30 which extends from the first portion 26.

Also, a second wall 32 extends from the first portion 26. The second wall 32 converges towards the first wall 30 in a direction from the first portion 26 towards the diverging nip DN.

The ventilator apparatus 10 as particularly shown in FIG. 1 includes a baffle 34 which is disposed between the first and the second portion 26, 28, respectively. The baffle 34 defines a plurality of perforations 36, 37, 38. The arrangement is such that when the first portion 26 is connected to the source of pressurized air 12, the perforated baffle 34 distributes the pressurized air into the second portion 28 prior to the current of air 24 flowing through and from the nozzle 22.

The second wall 32 has a first and a second end 40, 42, respectively. The first end 40 is disposed adjacent to the first portion 26 and the second end 42 defines the nozzle 22.

The nozzle 22 is a slot 44 which extends in a cross-machine direction CD along an entire width of the felt F.

Figure 3:
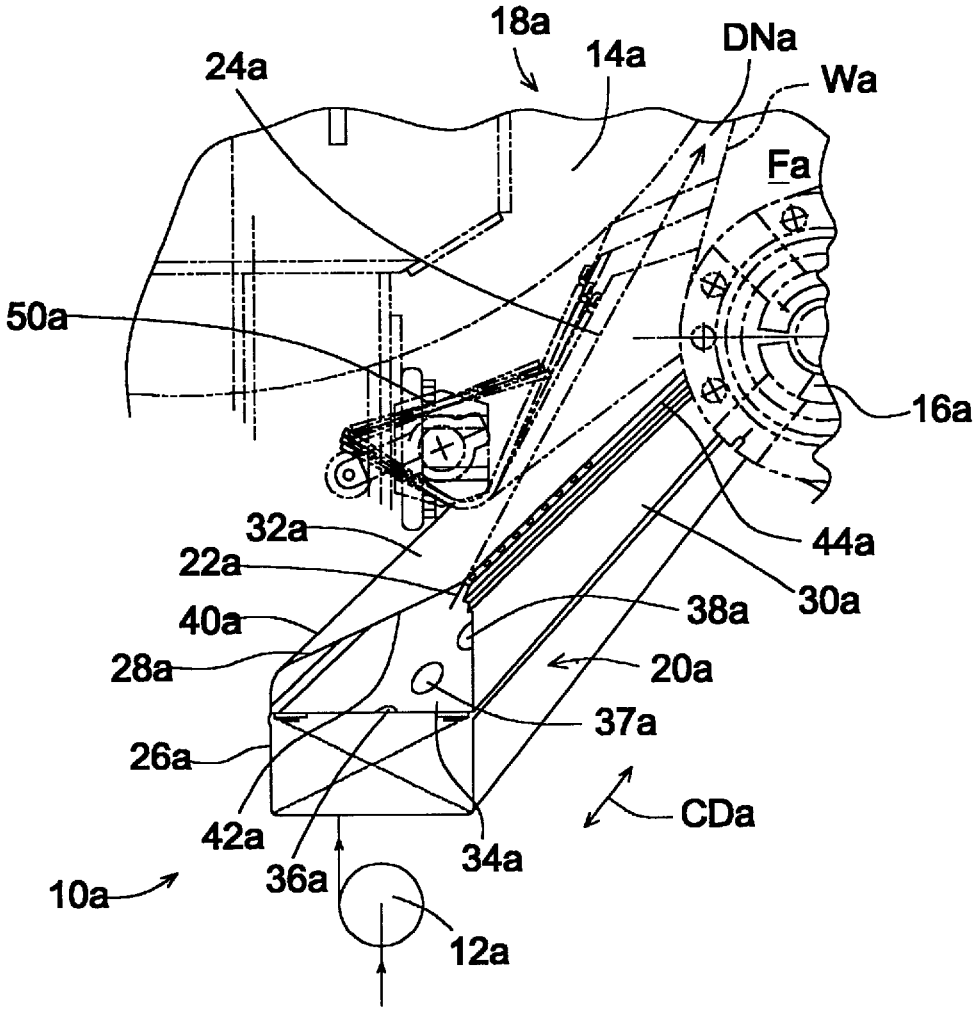
FIG. 3 is a similar view to that shown in FIG. 1 but shows an alternative embodiment of the present invention.

In an alternative embodiment of the present invention as shown in FIG. 3, the nozzle 22A includes a plurality of holes 46, 47, 48 which extend in the cross-machine direction CDa across an entire cross-machine directional width of the felt Fa.

Additionally, the ventilator apparatus 10 as shown in FIGS. 1 and 2 further includes a doctor 50 which cooperates with the dryer 14. The housing 20 is disposed closely adjacent to the doctor 50 such that the doctor 50 and the housing 20 cooperate together for directing the current of air 24 towards the diverging nip DN as particularly shown in FIG. 2.

The tapered second portion 28 of the housing 20 permits guidance therepast of broke (not shown) removed from the dryer 14 by the doctor 50 when the doctor 50 is in the operative disposition thereof with a blade of the doctor 50 in contact with a surface of the dryer 14.

The current of air 24 assists in urging the web W against the felt F during travel of the felt F between the dryer 14 and the roll 16 thereby stabilizing the web W relative to the felt F.

The current of air 24 flows from the nozzle 22 at a velocity of at least 4,000 feet per minute.

In operation of a conventional Bel-Champ single tier drying section, instability of the web in the area directly following the contact of the web with the dryer has been observed. Depending on the type of paper being made and the machine speed, the web or sheet would have the tendency to follow the surface of the dryer and then be pulled back to the dryer fabric or felt and vacuum roll. The realignment of the sheet to the felt path at times can result in the edges of the paper web fluttering. Such flutter or sheet separation has occasionally resulted in a sheet flutter that has created web breaks and machine downtime.

Analysis of the mechanics involved in the point of separation of the dryer and web reveal that a slight underpressure is generated at the diverging nip. Such underpressure combined with the inherent cohesion of the web to the dryer surface results in the tendency of the web to follow the dryer. However, as the web moves away from the dryer, the diverging nip must be filled with ambient air. Such inflow of ambient air near the web causes air movement in a direction opposite to that of the web and/or at right angles to the sheet from the edges thereof. The right angle edge flow causes a lifting or fluttering of the sheet edges.

The ventilator apparatus according to the present invention provides a directional forced air supply that can be adjusted to fill the void or underpressure as it is generated. Another objective of the present invention is that of providing a slight overpressure in the divergent nip area where the sheet contacts the felt between the dryer and the following vacuum felt roll. The positive pressure applied to the web generates a normal force between the sheet and the dryer fabric. With the application of such normal forces, the sheet is stabilized relative to the fabric and therefore the web remains in contact with the fabric or felt between the dryer and the vacuum felt roll.

What is claimed is:

1. A ventilator apparatus for supplying air from a source of pressurized air between a dryer and a web supported by a felt extending around a roll of a single tier drying section, said apparatus comprising:

a housing connected to the source of pressurized air, said housing defining a nozzle for directing a flow therethrough of a current of air; and said flow being directed from said nozzle towards a diverging nip defined between the dryer and the web supported by the felt when the felt diverges away from the dryer prior to the felt extending around the roll, the arrangement being such that said flow of air compensates for an underpressure generated by the felt when diverging away from the dryer so that fluttering of the web is inhibited.

2. A ventilator apparatus as set forth in claim 1, wherein said housing extends in a cross-machine direction across a full width of the felt.

3. A ventilator apparatus as set forth in claim 1, wherein said housing includes:

a first portion of generally rectangular configuration;

a second portion of generally tapered configuration, said second portion being disposed between said first portion and the diverging nip.

4. A ventilator apparatus as set forth in claim 3, wherein said first portion provides rigidity to said housing.

5. A ventilator apparatus as set forth in claim 3, wherein said second portion includes:

a first wall which extends from said first portion;

a second wall which extends from said first portion, said second wall converging towards said first wall in a direction from said first portion towards the diverging nip.

6. A ventilator apparatus as set forth in claim 3, wherein said second portion being tapered enables said housing to be disposed in close proximity relative to the diverging nip.

7. A ventilator apparatus as set forth in claim 3 further including:

a baffle disposed between said first portion and said second portion, said baffle defining a plurality of perforations, the arrangement being such that when said first portion is connected to the source of pressurized air, said perforated baffle distributes the pressurized air into said second portion prior to said current of air flowing through said nozzle.

8. A ventilator apparatus as set forth in claim 5, wherein said second wall has a first and a second end, said first end being disposed adjacent to said first portion, said second end defining said nozzle.

9. A ventilator apparatus as set forth in claim 1, wherein said nozzle is a slot extending in a cross-machine direction along an entire width of the felt.

10. A ventilator apparatus as set forth in claim 1, wherein said nozzle includes:

a plurality of holes which extend in a cross-machine direction across an entire cross-machine directional width of the felt.

11. A ventilator apparatus as set forth in claim 1, further including:

a doctor which cooperates with the dryer;

said housing being disposed closely adjacent to said doctor such that said doctor and said housing cooperate together for directing said current of air toward said diverging nip.

12. A ventilator apparatus as set forth in claim 3, wherein said tapered second portion permits guidance there past of broke removed from the dryer by said doctor.

13. A ventilator apparatus as set forth in claim 1, wherein said current of air assists in urging the web against the felt during travel of the felt between the dryer and the roll thereby stabilizing the web relative to the felt.

14. A ventilator apparatus as set forth in claim 1, wherein said current of air flows from said nozzle at a velocity of at least 4,000 feet per minute.

15. A ventilator apparatus for supplying air from a source of pressurized air between a dryer and a web supported by a felt extending around a roll of a single tier drying section, said apparatus comprising:

a housing connected to the source of pressurized air, said housing defining a nozzle for directing a flow therethrough of a current of air;

said flow being directed from said nozzle towards a diverging nip defined between the dryer and the web supported by the felt when the felt diverges away from the dryer prior to the felt extending around the roll, the arrangement being such that said flow of air compensates for an underpressure generated by the felt when diverging away from the dryer so that fluttering of the web is inhibited; and said nozzle defining a slot which extends in a cross-machine direction along substantially an entire width of the felt.

16. A ventilator apparatus for supplying air from a source of pressurized air between a dryer and a web supported by a felt extending around a roll of a single tier drying section, said apparatus comprising:

a housing connected to the source of pressurized air, said housing defining a nozzle for directing a flow therethrough of a current of air;

said flow being directed from said nozzle towards a diverging nip defined between the dryer and the web supported by the felt when the felt diverges away from the dryer prior to the felt extending around the roll, the arrangement being such that said flow of air compensates for an underpressure generated by the felt when diverging away from the dryer so that fluttering of the web is inhibited; and said current of air flowing from said nozzle at a velocity greater than 4,000 feet per minute.

* * * * *